United States Patent [19]

Reynolds

[11] 4,004,532

[45] Jan. 25, 1977

[54] RISER TENSION SYSTEM FOR FLOATING PLATFORM

[75] Inventor: Thomas J. Reynolds, Lake Stevens, Wash.

[73] Assignee: Western Gear Corporation, Everett, Wash.

[22] Filed: May 5, 1975

[21] Appl. No.: 574,378

[52] U.S. Cl. ..... 114/256; 175/5; 254/172; 254/93 R; 267/126

[51] Int. Cl.[2] ..... B63B 35/44

[58] Field of Search ..... 114/.5 D, 230, 214; 267/123, 124, 125; 248/18; 175/5, 27; 254/172, 93 R; 166/.5

[56] References Cited

UNITED STATES PATENTS

| | | | |
|---|---|---|---|
| 2,483,239 | 9/1949 | Sharpe | 254/93 R |
| 3,208,728 | 9/1965 | Parks | 175/27 |
| 3,793,835 | 2/1974 | Larralde | 267/126 X |

*Primary Examiner*—George E. A. Halvosa
*Assistant Examiner*—Gregory W. O'Connor
*Attorney, Agent, or Firm*—Seed, Berry, Vernon & Baynham

[57] ABSTRACT

A riser is tensioned from a floating platform by the use of one or more active hydraulic heave compensator units, each having an in-line backup unit coupled thereto so that the backup unit will automatically take over the load if there is loss of pressure in the active unit.

23 Claims, 2 Drawing Figures

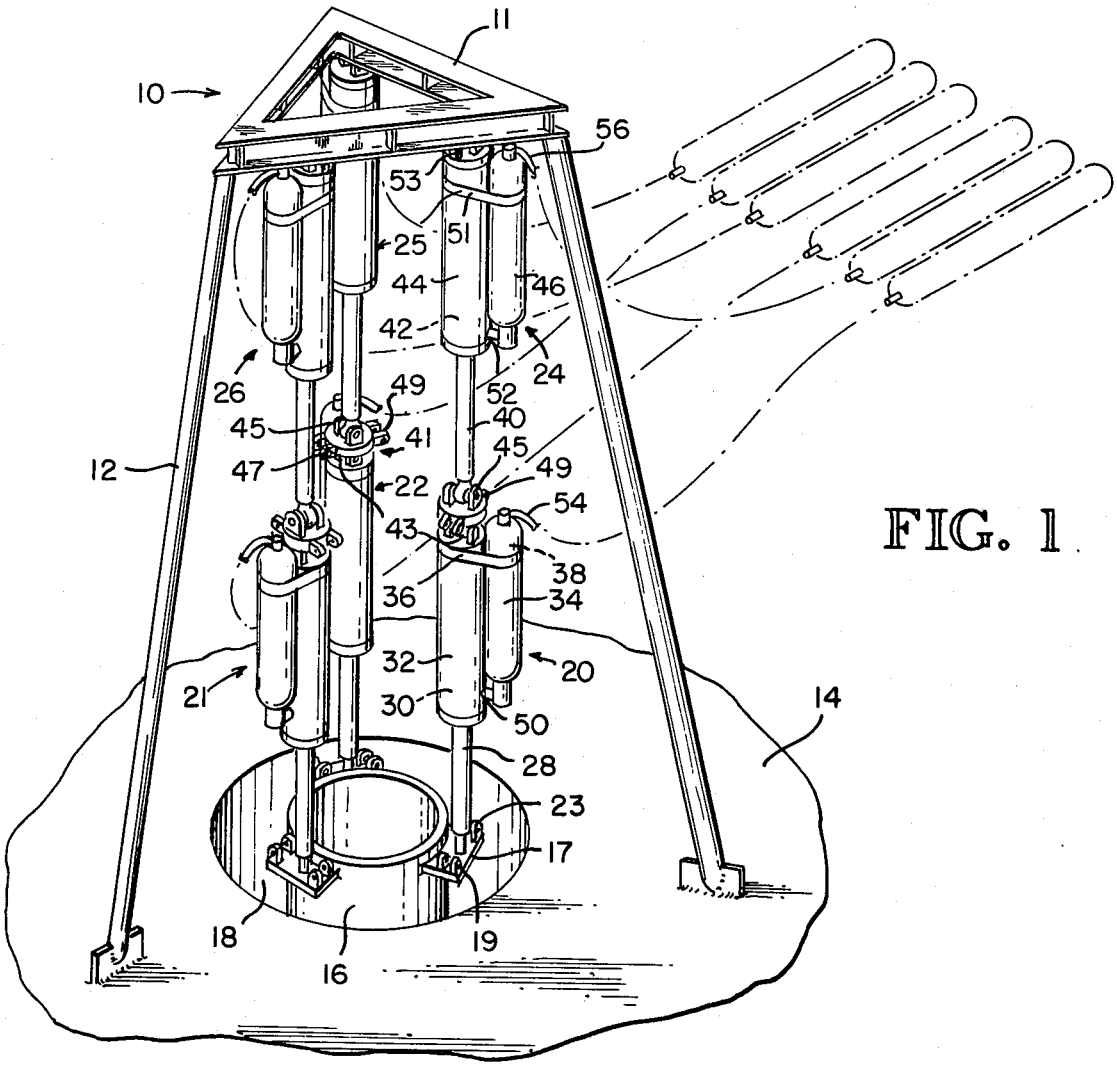
FIG. 1
FIG. 2
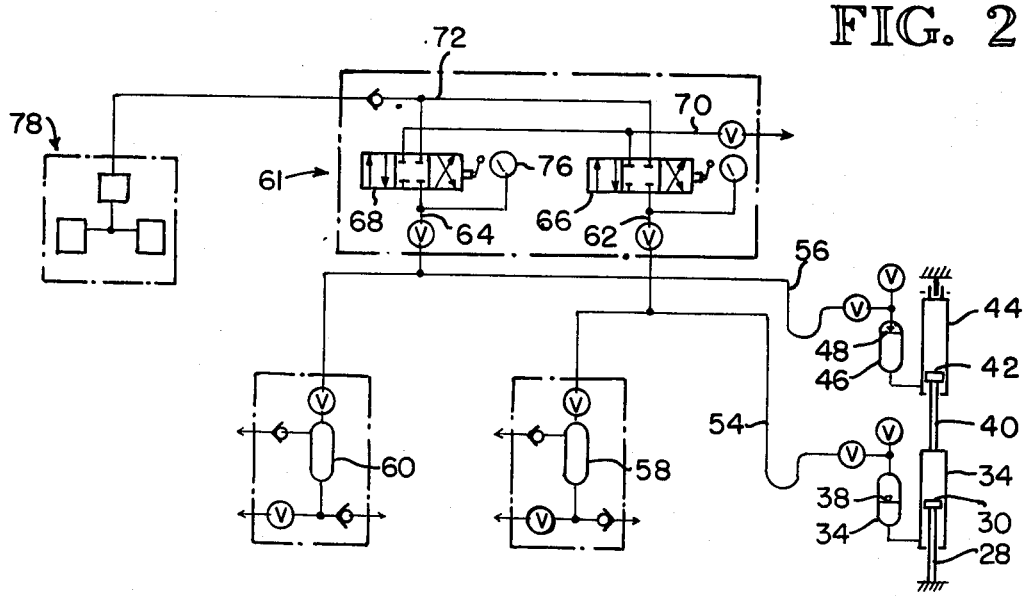

RISER TENSION SYSTEM FOR FLOATING PLATFORM

BACKGROUND OF THE INVENTION

1. Field of the Invention

The present invention relates to heave compensators for use on a floating platform to tension an oil production riser extending to the platform from the ocean floor.

2. Description of the Prior Art

Production risers from offshore oil wells normally must be supported at the water surface to prevent collapse. This is readily accomplished when the oil production platform is fixed to the ocean floor, but presents a significant problem when the water depth is so great that the platform must be floating and hence is not stationary.

Riser tensioners have been developed for use during drilling operations from a floating platform to compensate for rise and fall of the platform from ocean swells. Such tensionsers have commonly comprised hydraulic compensating cylinders connected by cables to the riser at symmetrically arranged tie points. In the course of their travel from the cylinders to a riser, the cables pass over one or more sheaves and hence are subject to wear. It thus becomes necessary to periodically adjust the cables so that unworn cable is shifted to the sheave locations, and, from time to time, the cables must be replaced. To make this cable replacement and cylinder repair possible, a duplicate riser tensioner system with independent riser connections has normally been installed as a backup.

The described riser tensioners used on floating drilling platforms could be used on a floating production platform, but the cable wear problem experienced therewith is more pronounced because the productive life of the well is so much longer than the original drilling of the well. Furthermore, it is not only necessary to have a backup system so that major repairs can be made, but it is preferred that the backup system automatically take over in case of failure of the normally active system.

SUMMARY OF THE INVENTION

Accordingly, the present invention aims to provide a riser tensioner system which eliminates the use of cables and sheaves, and includes an automatic backup.

A further object is to provide a riser tensioner system which permits a major component, such as a cylinder or piston, to be removed while the backup is in operation.

Another object of the invention is to provide such a system in which fluid lines are normally not required to move or flex.

In carrying out these objectives, the tensioner of the present invention comprises one or more sets of two in-line hydraulic heave compensating cylinder units, one unit being connected to the riser and the other being connected to an elevated support on the floating platform. One of these cylinder units, preferably the lower of the two, functions as the primary heave compensating unit, and the other serves as a backup unit in the event the primary unit fails. Each cylinder unit has its oil pressurized in a respective air/oil accumulator, in turn having its air pressurized from an independent air pressure vessel whose pressure is maintained by the use of an air compressor and dryer when the pressure drops below an established level. Tension rods can be placed in parallel to either of the cylinder units to take the load therefrom while the unit is being repaired or replaced.

When used in the description and claims, it is intended that "floating platform" include a semi-submersible.

BRIEF DESCRIPTION OF THE DRAWINGS

In the accompanying drawings:

FIG. 1 is a perspective view illustrating the riser tensioning system in operative position with the cylinder units fully extended.

FIG. 2 is a schematic of the control and pressure charging arrangement for the riser tensioning system showing the cylinder units in a normal operating state.

DETAILED DESCRIPTION OF THE INVENTION

Referring to FIG. 1, a tripod derrick 10 is shown with its legs 12 mounted on the deck 14 of a floating platform having an opening 18 to expose a production riser 16 extending thereto from the ocean floor. For simplicity of illustration, none of the normal fittings and equipment at the head of the riser have been shown. Suspended from the triangular crown 11 of the derrick are three riser tensioner sets arranged symmetrically relative to the riser circumference. These sets comprise three bottom active heave compensator units 20–22 coupled to three backup heave compensator units 24–26. Since all three of these sets are identical, only one of them will be described in detail.

Directing attention to the set of compensator units 20, 24, it is seen that they may be the same. Unit 20 comprises a hydraulic cylinder 32 in which a piston 30 operates with its rod 28 projecting downwardly to connect to a mounting flange or bracket 17 on the riser 16. An air/oil accumulator 34, with a floating piston 38, is clamped to the cylinder 32 by strap 36 and has an oil connection 50 to the bottom of the cylinder to charge the underside of the piston 30. The top of the accumulator 34 is interconnected by an air hose 54 with an air pressure vessel 58 on the deck 14.

Similarly, the backup cylinder unit 24 comprises a cylinder 44 connected by a clevis assembly to the underside of the crown 11 and having a piston 42 with its rod 40 projecting downwardly. In this instance, the piston rod is coupled to the top of the other cylinder 32. This coupling is preferably accomplished such as to permit either of the two cylinder units to be temporarily replaced by a pair of tension rods in case major repair or replacement is required. To this end there is shown an adapter 41 which provides a pair of clevis ears 45 at the top to make a pin connection with an eye at the free end of the piston rod 40 and provides an eye 43 at the bottom to connect to a pair of clevis ears at the upper end of the cylinder 32. In addition, the adapter 41 has diametrically opposite pairs lateral ears 47, 49. Aligned with these ears are pairs of ears 23, 19 on the riser and pairs of ears 53 on the underside of the crown 11. By this arrangement, a pair of tension rods (not shown) with eyes at their ends can be temporarily connected between the appropriate of said pairs of ears to extend along opposite sides of cylinder 32 or 44 and relieve it from any load or potential load so that it can be repaired or replaced. As an alternative to using a pair of temporary rods, two pairs of opposed permanent rods with longitudinal slots (not shown) can be installed, one pair alongside of the active cylinder unit and the other pair alongside of the respective backup cylinder unit. The longitudinal slots replace the eyes at the adapter end of the rods and extend along the rods slightly less than the full travel range of the pistons 30, 42. The pairs of ears 47 and 49 are given proper spacing and length to permit the rods to overlap therebetween and have the clevis pins extend through the longitudinal slots of the overlapping rods and work along the slots as the piston rods work in their cylinders.

The underside of the piston 42 is charged through a bottom connection 52 from an air/oil accumulator 46 mounted on the cylinder 44 by strap 51 and having the upper air side of its floating piston 48 charged via a hose 56 from an air pressure vessel 60 which may be mounted beside the vessel 58. As indicated in FIG. 2, the pressure vessels 58, 60 are connected via pressure lines 62, 64 with respective four-way valves 66, 68. These valves also connect to a vent line 70, and by a pressure line 72 to an air compressor and dryer unit 78. Gauges 76 are connected to the pressure lines 62, 64 to visually indicate the pressure in the accumulators 34, 46 so that the valves 66, 68 can be manually adjusted to normally maintain a pressure differential between the active cylinder unit 20 and the backup unit 24. This differential should be such that the pressure in the backup unit is always less than that in the active unit when the latter is in operation. For example, the median pressure in the backup unit can be about 1,800 p.s.i., while the median pressure in the active unit is about 2,200 p.s.i.

The valves 66, 68 and pressure gauges 64 for all three heave compensators may be mounted in a suitable control panel 61. It is preferred that a warning light be provided on the panel to indicate when one of the active cylinder units reaches and remains in a fully extended position, thereby indicating a malfunction of that unit and a take-over of its function by the respective backup cylinder unit. This backup is automatically performed because the backup cylinder units are constantly exposed with pressure from their accumulators. Normally the piston rods 40 of the backup units 24–26 are fully extended because the pressure in the active units 20–22 is greater than that in the backup units. However, if one of the active units loses sufficient pressure, due to a broken line, loss of seal packing, or some other malfunction, that its pressure drops below that in the backup units, the respective backup unit will take over the load from the malfunctioning active unit and the piston in the latter will bottom out. To indicate when this occurs, a warning can be provided, as, for example, by a horn or red light turned on by operation of a limit switch which can be mounted on the respective bracket 17 such as to be engaged by a lug fixed at the lower end of a rod (not shown) depending from the side of the malfunctioning cylinder in parallel, spaced relation to the respective piston rod 28.

When a malfunction of one of the active cylinder units 20–22 does occur, and the respective backup unit takes over the load of the malfunctioning active unit, the operator then starts the compressor 78 and operates the respective valve 68 to connect the pressure line 72 from the compressor to the pressure line 64 passing to the respective air pressure vessel 60 so as to raise the pressure in that vessel to the level of the pressure in the pressure vessels 58 of the other two active cylinder units. In this way, a balanced load on all three sets of heave compensators will be maintained while the malfunctioning cylinder is out of commission. While this cylinder is being repaired, the pressure therein can be vented through lines 62 and 70 by operation of the respective valve 66. As has been previously explained, the malfunctioning active cylinder unit may be completely disconnected top and/or bottom by temporarily introducing a pair of tension rods along opposite sides thereof. Suitable check valves and manual shutoff and vent valves are provided to permit isolation of the various components of the air/oil system for repairs.

It will be appreciated by one skilled in the art that the control system can be made more sophisticated to automate the operation of the valves 66, 68 and compressor 78. It is also to be understood that the use of three sets of heave compensators has been shown only for purposes of example. A single set can be used with a suitable bridle, and multiples other than three can be used as long as they are mounted in a symmetrical relationship.

Furthermore, with respect to the illustrated embodiment, the backup cylinder unit 24 is shown as being the same size as the active unit 20 so that a differential between the oil pressures in the two units provides a force advantage for the active unit whereby it normally overrides the backup unit. It will be appreciated that this force advantage can also be provided by having the effective area of the underside of the piston 30 greater than that of the piston 42, and by having both units 20, 24 charged with the same pressure. In that case the accumulators 34, 46 could be connected to a common air pressure vessel or bank of vessels.

It is intended that although in FIG. 1 a single pressure vessel has been shown in phantom for each heave compensating unit, a respective bank of multiple pressure vessels could be provided for increased sensitivity. Also, although air has been indicated as the gas used to charge the accumulators, it will be appreciated that nitrogen or some other suitable gas or gas mixture could be used instead.

The embodiments of the invention in which a particular property or privilege is claimed are defined as follows:

1. In combination;
a floating platform,
a load in the water below said platform,
an active heave compensator system, and
a back-up heave compensator system, one of said systems being supported by said platform and giving support to the other said system, the other said system being operatively connected between the load and the platform supported system.

2. The combination of claim 1 in which said active heave compensator system is operatively connected to the load.

3. The combination of claim 1 in which said load is a riser.

4. The combination of claim 1 in which said systems each have extended and retracted positions, said back-up system normally being in its extended position while said active system works between its extended and retracted positions.

5. The combination of claim 1 in which said systems are both pressurized, the back-up system normally being at less pressure than the active system whereby the active system overrides the back-up system unless the pressure in the active system becomes lower than the pressure in the back-up system.

6. The combination of claim 1 in which said systems include vertically aligned and coupled hydraulic heave compensators.

7. The combination of claim 1 in which said load comprises a riser, and one of said systems comprises a first hydraulic heave compensator connected to said riser, and the other of said systems comprises a second hydraulic heave compensator vertically aligned with and coupled to said first compensator and connected to said platform.

8. The combination of claim 7 in which respective liquid gas accumulators are mounted on said first and second heave compensators, and respective pressurized air vessels on said platform connected by flexible means to said accumulators.

9. The combination of claim 1 in which said systems each exert an upward force relative to the platform, the upward force exerted by the back-up system being less than that exerted by the active system whereby the active system overrides the back-up system unless the pressure in the active system drops to a level whereat the upward force exerted by the active system becomes less than that exerted by the back-up system.

10. The combination of claim 1 in which said load is a riser and said active system comprises multiple hydraulic heave compensators symetrically connected to the riser and said back-up system comprises a respective hydraulic heave compensator for each said compensator in the active system.

11. The combination of claim 1 in which said active system comprises an upright hydraulic cylinder and a piston in said cylinder having a piston rod projecting downwardly from the cylinder and connected to said load, and in which said back-up system comprises an upright cylinder component and a respective piston in the latter having a piston rod component projecting endwise from the cylinder, one of said components being coupled to said cylinder of the active system and the other said component being supported by the floating platform.

12. The combination of claim 11 in which said piston rod component is coupled to said cylinder of the active system and said cylinder component is interconnected with said platform.

13. The combination of claim 11 in which said systems include pressure means for hydraulically pressurizing said active cylinder and back-up cylinder component beneath the respective said pistons.

14. The combination of claim 13 in which said pressurizing is such that the resulting upward force exerted on the piston in the back-up cylinder component is normally less than the resulting upward force exerted on the piston in the active cylinder.

15. The combination of claim 13 in which said pressure means comprises respective gas/liquid accumulators carried by said active cylinder and back-up cylinder component and having their liquid side connected to the lower ends of the respective said cylinder and cylinder component; respective flexible gas lines connected to the gas side of said accumulators, said piston rod component of the back-up system being coupled to said cylinder of the active system, and said cylinder and cylinder component being vented above their respective pistons.

16. The combination of claim 11 in which means are provided for mounting a pair of rods in parallel relation to said cylinder or cylinder component such that either of the latter can be disconnected for repair or replacement.

17. In combination,
a floating platform,
a load in the water below said platform and connected to the ocean floor,
an upright active cylinder having a piston and a piston rod connected to said load, and
an upright back-up cylinder interconnected with said platform and having a piston and a piston rod coupled solely to the upper end of said active cylinder.

18. The combination of claim 17 in which a derrick is mounted on said platform and said back-up cylinder is suspended from said derrick.

19. The combination of claim 17 in which adapter means is provided at the coupling between the active cylinder and the piston rod of the back-up cylinder, said adapter means being adapted to receive connection from temporary rods located opposite either of said cylinders and connected to the load or the platform to temporarily take over the load from the cylinder.

20. In combination,
a support,
a load,
an active hydraulic cylinder unit,
a back-up hydraulic cylinder unit,
said units each having a cylinder component, a piston element in the cylinder component, and a piston rod component projecting endwise from said cylinder component,
first coupling means vertically interconnecting one of said components of said active unit solely with one of said components of said back-up unit,
second coupling means vertically interconnecting the other component of one of said units solely with said support, and
third coupling means vertically interconnecting the other component of the other of said units solely with said load, in which said first and third coupling means are adapted to receive the ends of tension rod means extending along opposite sides of said active cylinder unit for temporarily taking over the load therefrom.

21. The combination of claim 20 in which said first and second coupling means are adapted to receive the ends of tension rod means extending along opposite sides of said back-up cylinder unit.

22. In combination,
a support,
a load,
an active hydraulic cylinder unit,
a back-up hydraulic cylinder unit,
said units each having a cylinder component, a piston element in the cylinder component, and a piston rod component projecting endwise from said cylinder component,
first coupling means vertically suspending one of said components of said active unit solely with one of said components of said back-up unit,
second coupling means vertically suspending the other component of one of said units solely with said support and
third coupling means vertically suspending the other component of the other of said units solely with said load, in which said cylinder components are charged with respective pressurized fluids such that the piston elements therein are urged to move in the same direction and with the net force in said direction on the piston element of the active unit exerted by its respective such fluid being greater than the net force in said direction on the piston element of the back-up unit exerted by its respective such fluid.

23. The combination of claim 1 in which said support is on a floating platform and said load is a production riser extending to said platform from the ocean floor.

* * * * *